US009895824B2

(12) United States Patent
Borowka et al.

(10) Patent No.: US 9,895,824 B2
(45) Date of Patent: Feb. 20, 2018

(54) PROCESS FOR PRODUCTION OF WOOD BASED MATERIALS FROM LIGNOCELLULOSE

(71) Applicant: Kronotec AG, Lucerne (CH)

(72) Inventors: Julia Borowka, Zary (PL); Joachim Hasch, Berlin (DE)

(73) Assignee: SWISS KRONO TEC AG, Lucerne (CH)

( * ) Notice: Subject to any disclaimer, the term of this patent is extended or adjusted under 35 U.S.C. 154(b) by 0 days.

(21) Appl. No.: 14/439,768

(22) PCT Filed: Nov. 6, 2013

(86) PCT No.: PCT/EP2013/073090
§ 371 (c)(1),
(2) Date: Apr. 30, 2015

(87) PCT Pub. No.: WO2014/072304
PCT Pub. Date: May 15, 2015

(65) Prior Publication Data

US 2015/0298346 A1 Oct. 22, 2015

(30) Foreign Application Priority Data

Nov. 6, 2012 (EP) ..... 12191376

(51) Int. Cl.

| | |
|---|---|
| ***B27N 3/08*** | (2006.01) |
| ***B27N 3/00*** | (2006.01) |
| ***B27N 1/00*** | (2006.01) |
| ***D21J 1/16*** | (2006.01) |
| ***D21H 11/00*** | (2006.01) |
| ***D21H 17/63*** | (2006.01) |
| ***D21J 1/00*** | (2006.01) |

(52) U.S. Cl.
CPC ..... *B27N 1/003* (2013.01); *B27N 3/00* (2013.01); *B27N 3/08* (2013.01); *D21H 11/00* (2013.01); *D21H 17/63* (2013.01); *D21J 1/00* (2013.01)

(58) Field of Classification Search
CPC . B27N 1/003; B27N 3/00; B27N 3/08; B27N 1/00; B27N 1/02; B27N 3/002; B27N 3/02; B27N 3/04; B27N 3/06; B27N 3/12; B27K 2200/10; B27K 2240/00; B27K 5/00; B27K 5/007; C08L 97/02; D21J 1/00; B32B 5/30; C01B 31/089; C01B 31/125; C08J 9/236; Y10T 428/249967; D21H 11/00; D21H 17/63
See application file for complete search history.

(56) References Cited

U.S. PATENT DOCUMENTS

| | | | | | |
|---|---|---|---|---|---|
| 5,250,491 | A * | 10/1993 | Yan | B01D 53/02 | 264/117 |
| 6,451,153 | B1 * | 9/2002 | Symons | B29C 70/58 | 156/276 |
| 7,825,050 | B2 * | 11/2010 | Wilfong | D04H 1/54 | 156/308.2 |
| 9,012,539 | B2 * | 4/2015 | Grunwald | B27N 1/003 | 524/13 |
| 2005/0281999 | A1 * | 12/2005 | Hofmann | B32B 5/18 | 428/304.4 |
| 2007/0142225 | A1 * | 6/2007 | Baker | C01B 31/089 | 502/425 |
| 2011/0099887 | A1 * | 5/2011 | Stinson | C10L 5/14 | 44/280 |
| 2011/0237713 | A1 * | 9/2011 | Grunwald | B27N 1/003 | 524/14 |
| 2012/0108707 | A1 * | 5/2012 | Gunschera | B27N 1/003 | 524/14 |
| 2014/0256859 | A1 * | 9/2014 | Gunschera | B27N 1/003 | 524/43 |
| 2014/0259890 | A1 * | 9/2014 | Beadles | C10L 11/04 | 44/522 |
| 2014/0363664 | A1 * | 12/2014 | Gier | C08J 5/24 | 428/331 |
| 2015/0298346 | A1 * | 10/2015 | Borowka | B27N 1/003 | 162/181.9 |

FOREIGN PATENT DOCUMENTS

| | | | | |
|---|---|---|---|---|
| CA | 2886475 A1 * | 5/2014 | | B27N 1/003 |
| CN | 201074383 | 6/2008 | | |
| CN | 101585204 | 11/2009 | | |
| CN | 101585204 A | 11/2009 | | |
| CN | 201824437 | 5/2011 | | |

(Continued)

OTHER PUBLICATIONS

British Columbia, Indorr Air Quality: Volatile Organic Compounds (VOCs), HealthLiknBC, No. 65d, Dec. 2014, pp. 1-2.*

(Continued)

*Primary Examiner* — Jose A Fortuna
(74) *Attorney, Agent, or Firm* — Andrew M. Calderon; Roberts Mlorkowski Safran Cole & Calderon, P.C.

(57) ABSTRACT

A process for production of wood-base materials from lignocellulosic comminution product is disclosed. The wood-base materials are treated with at least one additive in the course of their production to reduce or diminish the emission of volatile organic compounds (VOCs) and, optionally, very volatile organic compounds (VVOCs), in particular terpenes and acids. The treatment is effected with one additive, being a porous carbon, like activated carbon. In another aspect, the present application is directed to the use of porous carbon, in particular, activated carbon, to reduce or diminish the emission of VOC, and optionally, VVOC, to reduce or diminish the emission of terpene and acids and aldehydes. Also, wood-base materials which are obtainable with the process or wood-based materials produced by using the additives mentioned above and which have reduced emission of VOCs, in particular terpenes and acids but also aldehydes are disclosed.

15 Claims, No Drawings

(56) References Cited

FOREIGN PATENT DOCUMENTS

| | | | | |
|---|---|---|---|---|
| CN | 102322564 | | 1/2012 | |
| EP | 1852231 | A2 | 11/2007 | |
| EP | 20530075 | | 4/2009 | |
| EP | 2727691 | B1 * | 12/2014 | ..... B27N 1/003 |
| JP | 10100116 | | 4/1998 | |
| JP | 2000202807 | | 7/2000 | |
| JP | 200380509 | | 3/2003 | |
| JP | 2003071815 | | 3/2003 | |
| JP | 2003080509 | | 3/2003 | |
| JP | 2003080509 | A1 | 3/2003 | |
| JP | 200371815 | | 12/2003 | |
| JP | 2004358399 | | 12/2014 | |
| KR | 1020100070790 | | 6/2010 | |
| WO | WO2005110742 | | 11/2005 | |
| WO | WO-2005110742 | A1 | 11/2005 | |
| WO | WO-2006032267 | A1 | 3/2006 | |
| WO | WO2007003404 | | 1/2007 | |
| WO | WO 2014072304 | A1 * | 5/2014 | ..... B27N 1/003 |

OTHER PUBLICATIONS

Austin Shepherd, "Activated Carbob Adsorption for Treament of VOC Emissions," May 2001, EnviroExpo, pp. 1-4.*

EPO Machine Translation of JP 2003071515 A, published on Mar. 12, 2003.*

EPO Machine Translation of JP 2004358399 A, published on Dec. 24, 2014.*

Salthammer, T in "Very Volatile organic compounds: an understudied class of indoor air pollutants," 2016, Indoor Air, vol. 26, pp. 25-38.*

Cecen, F, in "Activated Carbon," Uploaded on Jun. 13, 2014, pp. 1-34.*

International Preliminary Report for related PCT Application No. PCT/EP2013/073090 dated May 21, 2015, 10 pages.

Chinese Office Action for related CN Application No. 201380058064.0 dated May 19, 2016, 9 pages.

Chinese Office Action for related CN Application No. 201380058064.0 dated Dec. 6, 2016, 8 pages.

Long Long et al., "Emission of aldehyde and terpene from four species of wood at normal temperature", China Wood Industry, vol. 21, No. 3, May 2007, 6 pages.

Long Long et al., "VOC emission from drying process of Chinese Fir", Scientia Silvae Sinicae, vol. 44, No. 1, Jan. 2008, pp. 107-116.

Li Wenbin et al., "Building interior and furniture design ergonomics (3rd Edition)", Beijing: Chinese Forestry Publishing House, Mar. 2012, pp. 236-237.

Wibowo et al.,"The Properties of Activated Charcoal f . . . (Calophyllum inophyllum Linn)", Jurnal Penelitian Hasil Hutan, vol. 28 No. 1, Dec. 29, 2009,12 pages.

Darmawan,"Nature of Active Shell Charcoal Kemiri and Formaldehyde Emission Absorbent utilization as medium density fiberboard",Bogor Agricultural University, 2008, 135 pages.

Kim et al.,"Effect of Bio-Scavengers on the Curing Behavior and Bonding Porperties of melamine-Formaldehyde Resins",Macromol. Mater Eng., 2006, 291, 1027-1034, 8 pages.

Darmawan et al.,"Effect of Activated Charcoal Addition on Formaldehyde Emissions of Medium Density Fiberboard",Journal of Forestry Reserach vol. 7 No. 2, 2010, 12 pages.

Santos et al.,"Charcoal Effect on the Mixture of Raw Materials Characteristics of Particle Board", Jurnal Penelitian Hasil Hutan, vol. 30 No. 3, Sep. 2009, 16 pages.

Pari et al.,"Charcoal Activated Materials as the Capture Formaldehyde Plywood", 2004, J. Tek. Ind. Pert. vol. 14 (1), 8 pages.

"Activated Carbon", Wikipedia, Oct. 9, 2015, 19 pages.

Japanese Office Action for related JP Application No. 2015-540164 dated May 9, 2017, 8 pages.

* cited by examiner

PROCESS FOR PRODUCTION OF WOOD BASED MATERIALS FROM LIGNOCELLULOSE

The present application relates to a process for production of wood-base materials from lignocellulosic comminution products, in particular for production of fibreboard panels or OSB panels, wherein these wood-base materials are treated with at least one additive in the course of their production to reduce or diminish the emission of volatile organic compounds (VOCs) and, optionally, very volatile organic compounds (VVOCs), in particular terpenes and acids. It is the invention that the treatment is effected with one additive, being a porous carbon, like activated carbon. In another aspect, the present application is directed to the use of porous carbon, in particular, activated carbon, to reduce or diminish the emission of VOC, and optionally, VVOC, particularly to reduce or diminish the emission of terpene and acids as well as aldehydes. The application finally is directed to wood-base materials which are obtainable with the process of the present invention or wood-based materials produced by using the additives mentioned above and have reduced emission of volatile organic compounds, in particular terpenes and acids but also aldehydes.

PRIOR ART

Lignocellulose or lignocellulosic materials, such as wood and wood comminution products and wood-base materials formed therefrom, such as wood-base material panels, contain inter alia volatile organic compounds (VOCs) and very volatile organic compounds (VVOCs). The emission of these VOCs and VVOCs, also referred to as total volatile compounds (TVOCs), from wood-base materials (WBMs) is a serious problem from the aspect of wood-type products being increasingly used indoors. Volatile organic compounds include not only saturated and unsaturated aldehydes but any volatile organics whose retention time in a gas chromatograph is between that of C6 (hexane) and C16 (hexadecane). VOCs are not a homogeneous class of substances, but a conglomeration of compounds. This includes inter alia organic acids, saturated and unsaturated aldehydes, alcohols, terpenes, aliphatics and aromatic hydrocarbons and much more besides. There are also the very volatile organic compounds (VVOCs), which include, for example, formaldehyde or formic acid. These VVOCs likewise evolve in the course of production but also in the use of wood-base materials. These compounds may be formed not only from adhesives in the course of curing, but also by reaction of compounds present in the wood-base material. The emission of VOCs in particular is based essentially on a release of compounds stemming from the wood-base material.

The emission of these volatile and very volatile ingredients of wood or constituents of adhesives from wood products of one of these wood-base material panels is becoming more and more of a problem because of tightened legislation on maximum allowable concentrations and/or heightened consumer awareness.

The release (evolution) of volatile organic compounds and very volatile organic compounds depends inter alia on the type and state of the lignocelluloses, such as the wood species, the storage time, the storage conditions of the wood and/or of the comminution products of the wood, and may occur in different chemical compositions and amounts. The VOCs derive essentially from extractives of the lignocelluloses, for example of the wood or transformation products. Prominent representatives thereof are compounds such as α-pinene, β-pinene, δ-3-carene. These constituents are found particularly in coniferous trees used as starting wood for wood-base material panels. Transformation products which appear for example during the storage and processing of the wood and of the comminution products include aldehydes, such as pentanal and hexanal. Especially coniferous woods used to produce predominantly flakeboard panels, medium density fibreboard (MDF) panels or OSB panels contain large amounts of resins and fats that lead to the formation of volatile organic terpene compounds and aldehydes. These compounds are in some cases also formed by breakdown of the main constituents of wood, such as lignin, cellulose and hemicellulose. Volatile organic compounds and very volatile organic compounds, however, can also form during the use of certain adhesives in the manufacture of wood-base materials. Typically an oxidation takes place of the wood ingredients, as of the fatty acids, which then lead to the secondary and/or tertiary emission of aldehydes, such as pentanal, or of higher carboxylic acids but also terpenes.

In other words, the VOC emission from wood-base materials is based essentially on an evolution due to the wood and not due to the adhesive used. Especially the ongoing transformation in the product wood-base materials of constituents of the wood-base materials, for example by fragmentation of the resins and fats, is responsible for a continual secondary or tertiary emission of the compounds in question. Today, OSB panels are also used in the construction sector. Since OSB panels typically have no emission-reducing coating and are installed in large amounts, in particular in terms of area of panel, based on the overall volume of the room or building, high evolutions of VOC may occur.

Similar problems with the emission of VOC and any VVOC can also be observed with the use of lightweight and superlightweight MDF for thermal insulation for example. Again there are emissions of secondaries and tertiaries.

Various attempts have already been made to control the problems due to the emission of volatile organic compounds and very volatile organic compounds. The admixture of a very wide variety of additives has been described. EP 1 852 231 proposes the use of various additives. The use of maleic anhydride or similar compounds to reduce the emission of formaldehyde is described therein for example. WO 2006/032267 discloses processes for reduction of unsaturated aldehydes and woods comprising fatty acid. In the process, the fatty acid ester in the wood is scissioned, inhibited or oxidized. It is proposed therein that antioxidants, alkaline compounds or oxidizing agents be added as an additive. One disadvantage of additives described to date, however, is that frequently only one particular class of substances is emission reduced, the aldehydes for example. By contrast, additives which the total emission of volatile organic compounds and, if appropriate, the very volatile organic compounds are scarcely known.

A further problem with the additives described to date is the need to admix them in the form of an aqueous solution, thereby raising the moisture level within the manufacturing operation. Yet additional moisture has to be removed again later via a costly and inconvenient drying operation. Furthermore, metered addition of additive-type solutions before the drying step often leads to increased soiling of the drying equipment. This results in increased maintenance requirements. Finally, many of the additives described have a corrosive effect on machines and components, since they are frequently organic or inorganic compounds which are added as salts in solutions and may have a corresponding corrosive effect on machines and other components.

Other disadvantages of existing chemical additives are their usually high costs. It is further possible for harmful effects due to an emission of these and/or of reaction products of these with ingredients of the further constituents of the wood-base material panels to occur in the manufacturing operation, in particular in the pressing operation under heat treatment, or in later use.

A particular disadvantage that has transpired is that the additives used to date may in some instances lessen the reactivity of the adhesives used. This causes mechanical parameters of the wood-base material panels to be produced to be influenced and typically to decrease. To compensate these disadvantageous effects due admixing the additives, the adhesive is admixed in larger amounts in order to attain the required and/or desired mechanical parameters.

On the other hand, however, emission limits are being lowered further and further by regulative provisions and by legislation but also in response to consumer demand. The demand for ecologically high-value wood-base materials with low VOC emissions is continually increasing and there is correspondingly a demand for the provision of additives to reduce the emission of VOC and any VVOC, i.e. total emission (TVOC) from the wood-base materials.

What is important here in particular is that the desired reduction of TVOC, such as VOCs and any VVOCs, from the wood-base materials should be possible even in prolonged use. Therefore, novel additives need to reduce not just the direct emission of VOCs in the course of the manufacturing operation, but particularly also the emission of VOCs but also of VVOCs, in particular of terpenes and acids but also compounds which as breakdown products of fatty acids evolve from the wood-base materials as secondary or tertiary emission.

The present invention therefore has for its object to provide processes for producing wood-base materials from particles of lignocelluloses, in particular processes for producing flakeboard panels, fibreboard panels or OSB panels but also plywood panels, wherein these exhibit a reduction/diminishment of emissions of volatile organic compounds (VOCs) and very volatile organic compounds (VVOCs) even over a prolonged period. In other words, the emission of VOCs but also of VVOCs shall be distinctly lower not only during production but also in later use. The additives used therein shall themselves not have any toxic properties and have no adverse effect on the manufacturing operation itself, particularly not by reducing the reactivity of the adhesives used. On the other hand, the additives shall reduce as comprehensively as possible the emission of the heterogeneous class of volatile organic compounds and also of very volatile organic compounds and/or any formation thereof from constituents of the wood-base materials.

DESCRIPTION OF THE INVENTION

The object of the present invention is achieved by a process having the features of claim 1 and also by a wood-base material having the features of claim 15, as well as the use of the additive of claim 12. Advantageous refinements and developments of the invention are recited in the dependent claims.

One essential aspect of the present invention is the use of porous carbon, particularly, activated carbon, as additive.

In other words, the present application is directed in a first aspect to a process for production of wood-base materials from lignocellulose, in particular fibreboard panels or OSB panels, comprising the steps of:

a) providing lignocellulosic comminution products, b) introducing an additive into the lignocellulosic comminution products, wherein the additive is porous carbon;

c) compression moulding the additive-admixed lignocellulosic comminution products with adhesive under heat treatment to produce the wood-base material; characterized in that adding the additives has at least the effect of reducing the emission of volatile organic compounds (VOCs), in particular terpenes and acids. The method allows to reduce the emission of the TVOC.

The surprise, then, is that the use of porous carbon, particularly, the activated carbon, lowers the total amount of VOCs and VVOCs emitted by the wood-base materials. This reduction involves not just a reduction with regard to aldehydes, but especially also with regard to the terpenes and the acids. Such a reduction was achieved not just in the short term but, instead, it transpired in particular that the reduction is also obtained for a prolonged period.

The expression "reducing the emission" or "diminishing the emission", which are used interchangeably, is predominantly to be understood as meaning that, compared with a wood-base material without additive of the present invention, the total amount of volatile organic compound (Total Volatile Organic Compounds TVOC) is lower. That is, when producing these wood-based materials or treating these wood-based materials with the additives as defined herein, the emission of the total amount of VOC or TVOC is reduced or lower compared to a comparable wood-based material produced without using the additive.

The expression "avoidance of emission" denotes a percentage reduction or diminishment in emission, compared with a control, down to one such that is below the measurement limit.

The expressions "lignocellulosic comminution products" and "particles of lignocelluloses" are used interchangeably herein.

A further advantage to reducing/diminishing the emission of TVOCs is that, for example, even such compounds are lowered in their emission as further also contribute to an unpleasant odour emanating from the wood-base materials, e.g. acetic acid, which is foul-smelling, but also the typical aldehyde—especially formaldehyde—odour of these panels.

It is preferred that the porous carbon is activated carbon. Activated carbon refers to carbon structures formed from minuscule crystals of graphite and from amorphous carbon with a porous structure and internal surface areas (BET surface area), typically in a range between 300 and 2000 $m^2/g$. Activated carbon can be present in powder form, as granules but also in other forms. The activated carbon or the porous carbon, respectively, concerned is preferably one having a density between 0.2 to 0.6 $g/cm^3$, while the pore size which is preferred for the porous carbon, particularly, activated carbon, is in the range from <1 nm up to 50 nm.

Activated carbon can be produced from vegetable, animal or mineral raw materials. Correspondingly, the activated carbon can come from bituminous coal, charcoal or lignite, but also from vegetable constituents, such as coconut shells, fruit kernels, etc., as well as from bone char.

Activated carbon is a well-known adsorbent used, for example, to remove undesirable or harmful colour- and odorants from gases, vapours and liquids etc. They are further known in chemical purifying operations and also for adsorption of, for example, toxins in the pharmaceutical sector.

In fact, activated carbon as a sorbent, like an adsorbent of liquids or gases is known for its shortness of service, not its use in permanent service.

The porous carbon, e.g. in form of activated carbon, may be introduced into the lignocellulosic comminution products in solid form as a powder preferably with a particle diameter of below 1 mm and/or as granules with a particle size of below 4 mm.

The additive is introduced therein for example in an amount ranging from 0.1 to 20 wt % on absolutely dry lignocellulose. Suitable ranges are e.g. ranges of 0.1 wt % to 1.5 wt %, like 0.1 wt % to 5 wt % on absolutely dry lignocellulose.

Using a porous carbon, e.g. in the form of activated carbon, has various advantages. Viewed from a commercial standpoint, activated carbon is highly available and inexpensive. In the manufacturing operation itself, disadvantages of prior art additives are overcome. It can be metered as a solid material, obviating any increase in the moisture content of the starting materials and/or the wood-base material panels. There is accordingly no need for additional drying with attendant additional costs. Nor does porous carbon, e.g. in the form of activated carbon, exhibit any reactivity with the adhesive used, so there is no adverse effect on the reactivity and processibility thereof, for example its rate of cure. So there is no need to add larger amounts of adhesive in order to rectify decreases in the reactivity thereof due to admixture of additives.

Total emission from wood-base materials of VOCs including any VVOCs is reduced, and this reduction is not restricted to one class of substances, but reduces not only the emission of aldehydes but also that of terpenes and acids. This accordingly leads to a significant lowering in the TVOC value and the R value of the wood-base materials obtained, in particular in the form of wood-base material panels, such as OSB panels. This R value is described by the German Committee for Health-Related Evaluation of Building Products (AgBB) as follows: R is the sum of all R for the individual compounds ($R_i$). $R_i$ in turn is the quotient formed by dividing the LCI (lowest concentration of interest) value of a compound i into the test chamber air concentration $c_i$ of said compound, $R_i=c_i/LCI$. According to AgBB, the R value should be 1 or less.

The additive may be added at various times in the manufacturing operation. And the additive may be added not only in solid form but optionally also as a suspension or dispersion. The porous carbon, e.g. in form of activated carbon, is preferably added as pulverulent granules in solid form.

The addition of the additive may in fact take place in all regions of the wood-base materials to be produced. In the case of wood-base material panels, such as OSB panels or fibreboard panels, the additive may for example be present only in individual regions thereof. In fact, the additive may be metered into the outer layer and/or into the middle layer.

According to the invention, in fact, the additive may be present in the outer layer or middle layer in different weight fractions. For instance, there may be a fraction of 5 wt % in one of the layers while the other layer includes 7.5% or 10% of the additive. It will be appreciated that the fractions in the two layers may also be the same.

Porous carbon, e.g. in the form of activated carbon, may in particular in powder form upstream of the dryer and/or downstream of the dryer in the falling shaft of the lignocellulosic comminution products for the control and/or upstream and/or downstream the resination thereof and/or in the resination with the corresponding adhesive, such as a UF, MUF, PMDI adhesive.

The admixture level of additive depends on whether the additive is used in the outer and/or middle layer. As recited, the metering level for the additive is from 0.1 to 20 wt % on absolutely dry lignocellulose, like 0.1 to 7.5 wt %, e.g. 0.1 to 5 wt % on absolutely dry lignocellulose.

Customarily employed adhesives may be used. These adhesives include as adhesives phenol-formaldehyde adhesives (PF adhesives), adhesives based on isocyanates, urea-formaldehyde adhesives (UF adhesives), melamine-urea-formaldehyde adhesives (MUF adhesives), melamine-urea-phenol-formaldehyde adhesives (MUPF adhesives), tannin-formaldehyde adhesives (TF adhesives), polyurethane adhesive (PU adhesive) or mixtures thereof.

In one preferred embodiment, the adhesive is a non-formaldehyde adhesive, such as an adhesive that is based on isocyanates, such as PMDI.

Lignocelluloses herein are lignocellulosic materials, such as wood. Lignocellulosic comminution products obtained therefrom include, in particular, wood strands, wood flakes, wood fibres, but also wood veneers.

The lignocelluloses, such as the wood-base materials and the comminution products thereof, may concern not only soft woods but also hardwoods. Mixtures of these two types of wood are also possible. The wood flakes, woods strands or wood fibres preferably come from softwoods. The wood-base materials, in particular wood-base material panels, obtainable with the production process of the present invention are obtainable in accordance with an existing process. And the process may optionally additionally supplement other, conventional processes for diminishing the emission of volatile organic compounds, very volatile organic compounds.

In another aspect, the present invention relates to the use of porous carbon, particularly of activated carbon, as an additive in the production of wood-base materials from lignocellulose like comminute lignocellulose, especially for reducing/diminishing the emission of VOC, TVOC and/or VVOC. According to the invention, the additive referred to is imported (introduced)/coated (applied) during the production operation of the lignocellulose e.g. present in the form of lignocellulosic comminution particles (lignocellulosic particles).

The corresponding use of the additive may take place at least in the outer layer or the middle layer or in both layers of, for example, OSB panels. According to the invention, the additive may in this use be introduced or applied in an amount of 0.1 wt % to 20 wt % like 0.1 wt % to 7.5 wt %, e.g. 0.1 wt % to 5 wt % of solids based on absolutely dry lignocellulose.

The invention finally provides wood-base materials obtainable with the process of the present invention. These wood-base materials are preferably a fibreboard panel, in particular a light or supertight MDF panel, an OSB panel.

The wood-base materials of the present invention are notable for their reduced or diminished emission of TVOC, including in particular a reduction/diminishment in terpenes and acids, over a long period. It further transpired that the mechanical properties of the wood-base materials obtained are only minimally affected, if at all, as indicated below in Table 3 for example.

Illustrative embodiments of the invention will now be more particularly described without the latter being restricted to the former.

Example 1

Production of Low-Emission OSB

Experimental Results for OSB

What was produced first in a laboratory press was a reference panel (panel 1) having 100% PMDI resination and a thickness of 12 mm. This was followed by the production of three experimental panels by use of activated carbon. Panel 2 thereof contains 5%, on absolutely dry wood, of activated carbon powder in the outer layer. Panel 3 contains 5%, on absolutely dry wood, of activated carbon powder in the middle layer, while in the case of panel 4 the middle layer was admixed with 10%, on absolutely dry wood, of activated carbon powder.

Table 1 hereinbelow contains an overview of the experimental panels produced. These were subsequently tested in a test chamber for their emission characteristics and evaluated in accordance with the AgBB scheme for a period of 28 days.

TABLE 1

| Panel | Thickness | Resination | Dosage |
|---|---|---|---|
| 1 | 12 | 100% PMDI | "0" standard panel |
| 2 | 12 | 100% PMDI | OSB panel with 5% AC in outer layer |
| 3 | 12 | 100% PMDI | OSB panel with 5% AC in middle layer |
| 4 | 12 | 100% PMDI | OSB panel with 10% AC in middle layer |

Performance of VOC Emission Measurement

The emission measurements took place in test chambers comprising glass desiccators having a volume of 23.5 litres. The tests were carried out on the basis of ISO 16 000 Part 9 (2008). Standard conditions were accordingly a temperature of 23° C., a relative humidity of 50% and an air speed of 0.1 to 0.3 m s-2 near the sample surface. The standard loading was around 720 $cm^2$ of emitting area, i.e. the degree of loading of the chamber was 3.1 m2 m-3; the air exchange with high-purity synthetic air in the test chamber took place 3.1 times per hour. This converts to a standard-conform area-specific air exchange rate of 1 $m^3/(m^2*h)$. Minimum test period was 28 days, during which the air was sampled after one day and three days after sample introduction and thereafter weekly. Sampling was in accordance with ISO 16 000 Part 6 (2004) by means of a pump and tubes packed with Tenax TA® adsorbent. The sampling volume in each case was 0.5 to not more than 4 litres of test chamber air. Before each air sample was taken, the tubes packed with Tenax TA® were thermally purified and charged with 200 g of deuterated toluene as internal standard. To identify and quantify the VOCs in the sample air, the sample-exposed Tenax TA was thermally desorbed (TD) and the substances transferred via a cryofocusing unit into a gas chromatograph (GC) coupled to a mass spectrometer (MS).

Results: VOC emissions after 1, 3, 7, 14, 21 and 28 days are shown in Table 2:

TABLE 2

| | TVOC $\mu g/m^3$ | | | | | | Hexanal $\mu g/m^3$ | | R |
|---|---|---|---|---|---|---|---|---|---|
| Panel | Day 1 | 3 | 7 | 14 | 21 | 28 | 1 | 28 | value |
| 1 | 3354.6 | | | 1299.9 | 1122.3 | 999.1 | 807.0 | 399.1 | 3.3 |
| 2 | 3330.2 | 2164.0 | 1742.0 | 1321.6 | 1040.0 | 980.8 | 811.6 | 360.7 | 2.4 |
| 3 | 665.4 | 553.2 | 445.4 | 441.1 | 351.7 | 265.5 | 131.1 | 79.4 | 1 |
| 4 | 980.3 | 659.5 | 567.6 | 522.5 | 410.8 | 382.9 | 216.4 | 107.3 | 1 |

The mechanical parameters of an OSB panel 12 mm in thickness and comprising 5% activated carbon in the middle layer (ML) are shown in Table 3 versus those of the reference panel without admixture of activated carbon:

TABLE 3

| Parameter | Reference panel | 5% activated carbon in ML |
|---|---|---|
| Apparent density | 687 | 671 |
| Flexural strength [MPa] | 43.46 | 37.33 |
| Modulus of elasticity [MPa] | 6322 | 6615 |
| Transverse strength [MPa] | 0.62 | 0.45 |
| Swelling [%] | 26.6 | 29.5 |

It transpired that the mechanical parameters scarcely change on admixture of activated carbon.

Example 2

In a further series of tests, the reference panel and a panel comprising 5% of activated carbon in the middle layer (ML) were tested in accordance with the AgBB requirements. This confirmed the results, as shown in Table 4.

TABLE 4

| Sample | Activated carbon [%] ML | Loading $[m^2/m^3]$ | Vent rate $[h^{-1}]$ | q $[m^3/(m^2*g)]$ | TVOC 28 d $[\mu g/m^3]$ | R 28 d |
|---|---|---|---|---|---|---|
| 1 | 0 | 1 | 1 | 1 | 565 | 1.563 |
| 2 | 5 | 1 | 1 | 1 | 242 | 0.838 |

Discussion of Results

The VOC emission measurements show the greatest reduction effect on adding the activated carbon powder in the middle layer. More particularly, activated carbon dosed at 5% on absolutely dry wood leads to a substantial reduction in VOC emission. Compared with the reference panel (panel 1), the TVOC value decreases from 999.1 $\mu g/m^3$ to 265.6 $\mu g/m^3$ (panel 3). Similarly, the R value is substantially reduced from 3.3 to 1 in the case of experimental panel 3 versus reference panel 1.

Example 3

VOC Reduction Due to Addition of Activated Carbon

Samples: plates 12 mm×400 mm×400 mm sample 0: standard plate: control without additive sample 1: 5% activated carbon: Donaucarbon (Germany) middle layer sample 2: 5% activated carbon: charcoal (Poch, Poland) middle layer Two different types of activated carbon have been used. Sample 1 corresponds to the activated carbon used in the previous examples.

The second type of activated carbon is a product obtained from Donaucarbon (product Desorex K47 F). The material is pressed and not as soft as the first product of Poch.

Results for VOC obtained after 28 days according to AgBB

The VOC analysis was done using a sectorial rate of ventilation of 1 $m^3/m^2 \times h$). All plates meet the requirements of the AgBB.

| No. | additive | amount | firm | TVOC [$\mu g/m^3$] | FA [ppm] | R-value |
|---|---|---|---|---|---|---|
| 0 | — | — | | 472 | 0.011 | 1.068 |
| 1 | activated carbon | 5% (MS) | | 257 | 0.008 | 0.189 |
| 2 | activated carbon | 5% (MS) | | 176 | 0.008 | 0.170 |

Compared to the control without additive, the highest reduction can be seen in sample 2 where the activated carbon of Poch has been used. The TVOC value is more than halved, as well as the formaldehyde is reduced to 0.008 ppm after 28 days. The highest reduction is also with the R-value to 0.170. Sample 1 with activated carbon of the company Donaucarbon also demonstrates remarkable reduction of the VOC emission.

Activated carbon has a high internal surface area and hence a high adsorption capacity. Owing to the high open-pore structure, activated carbon has the ability to sorb and retain large amounts of gas molecules. Activated carbon is a hydrophobic adsorbent and particularly suitable for the adsorption of comparatively less polar VOCs, such as terpenes. Chemisorption plays a large part here as well as physisorption in that the VOC molecules are capable of entering chemical interactions with the surface molecules of the activated carbon to genuinely form a surface compound.

The invention claimed is:

1. A process for production of an oriented strand board (OSB) panel from lignocellulose comprising:

a) providing lignocellulosic comminution products, b) introducing an additive into the lignocellulosic comminution products whereby the additive is an activated carbon, and c) compression moulding the additive-admixed lignocellulosic comminution products with a formaldehyde-free adhesive under heat treatment to produce the OSB panel, wherein the additive is introduced in an amount of 0.1 to 5.0 wt % on absolutely dry lignocellulose, wherein in that by addition of the additive emission of volatile organic compounds (VOCs) having a retention time in a gas chromatograph between that of hexane and hexadecane is reduced.

2. The process for production of OSB panel from lignocellulose according to claim 1, wherein the activated carbon is introduced into the lignocellulosic comminution products in solid form as a powder with a particle diameter of <1 mm and/or as granules with a particle size of up to 4 mm.

3. The process for production of OSB panel from lignocellulose according to claim 1, wherein an internal surface area of the activated carbon is at least one of between 300 and 2000 $m^2/g$ and density is between 0.2 to 0.6 $g/cm^3$ and pore size is on average between 1 mm and 50 nm.

4. The process for production of OSB panel from lignocellulose according to claim 1, wherein the adhesive is a formaldehyde-free adhesive which is based on isocyanates.

5. The process for production of OSB panel from lignocellulose according to claim 1, wherein the lignocellulosic comminution products are selected from wood flakes, wood strands or wood fibres.

6. The process for production of OSB panel from lignocellulose according to claim 1, wherein the activated carbon is at least introduced as additive into the lignocellulosic comminution products forming an outer layer.

7. The process for production of OSB panel from lignocellulose according to claim 1, wherein the activated carbon is at least introduced as additive into the lignocellulosic comminution products forming a middle layer.

8. The process for production of OSB panel from lignocellulose according to claim 1, wherein the additive is added during a resination step and upstream or downstream of the resination step.

9. The process for production of OSB panel from lignocellulose according to claim 1, wherein the activated carbon is admixed as at least one of powder, granules, suspension and dispersion.

10. The process for production of OSB panel from lignocellulose according to claim 9, wherein the activated carbon is admixed as pulverulent granules in solid form.

11. The process for production of OSB panel from lignocellulose according to claim 1, wherein VOCs are terpenes and acids.

12. A method of using activated carbon, as additive in production of OSB panel from lignocellulose for reducing the emission of VOC having a retention time in a gas chromatograph between that of hexane and hexadecane wherein the additive is introduced or applied during a production process of the OSB panel, admixed with comminuted lignocellulosic products and/or with a formaldehyde-free adhesive and in amount from 0.1 to 5.0 wt. % on absolutely dry lignocellulose.

13. A process for production of OSB panel from lignocellulose comprising:

a) providing lignocellulosic comminution products, b) introducing an additive into the lignocellulosic comminution products whereby the additive is a an activated-carbon, and c) compression moulding the additive-admixed lignocellulosic comminution products with adhesive under heat treatment to produce the OSB panel, wherein the additive is introduced in the amount of 0.1 to 5.0 wt % on absolutely dry lignocellulose, wherein in that by addition of the additive emission of volatile organic compounds (VOCs) having a retention time in a gas chromatograph between that of hexane and hexadecane is reduced, wherein the porous carbon is activated carbon which is added as a suspension or dispersion.

14. The process for production of OSB panel from lignocellulose according to claim 13, wherein the activated carbon is added into the outer layer or middle layer in different weight fractions.

15. The process for production of OSB panel from lignocellulose according to claim 14, wherein the different weight fractions include a fraction of 5 wt % in one of the layers while the other layer includes 7.5% or 10%.

* * * * *